US009737749B2

(12) United States Patent
Chang

(10) Patent No.: US 9,737,749 B2
(45) Date of Patent: Aug. 22, 2017

(54) MODULAR FITNESS DEVICE

(71) Applicant: Cheng-Cheng Chang, Yunlin County (TW)

(72) Inventor: Cheng-Cheng Chang, Yunlin County (TW)

( * ) Notice: Subject to any disclaimer, the term of this patent is extended or adjusted under 35 U.S.C. 154(b) by 0 days.

(21) Appl. No.: 15/044,789

(22) Filed: Feb. 16, 2016

(65) Prior Publication Data

US 2016/0256729 A1 Sep. 8, 2016

(30) Foreign Application Priority Data

Mar. 5, 2015 (CN) ..... 2015 2 0126811 U

(51) Int. Cl.

| | |
|---|---|
| ***A63B 21/00*** | (2006.01) |
| ***A63B 21/06*** | (2006.01) |
| ***A63B 21/062*** | (2006.01) |
| ***A63B 23/035*** | (2006.01) |
| *A63B 71/00* | (2006.01) |
| *A63B 23/04* | (2006.01) |
| *A63B 23/12* | (2006.01) |

(52) U.S. Cl.

CPC ..... *A63B 21/0628* (2015.10); *A63B 21/154* (2013.01); *A63B 23/03516* (2013.01); *A63B 21/4034* (2015.10); *A63B 21/4035* (2015.10); *A63B 23/0405* (2013.01); *A63B 23/1218* (2013.01); *A63B 23/1236* (2013.01); *A63B 23/1263* (2013.01); *A63B 71/0054* (2013.01); *A63B 2071/0072* (2013.01)

(58) Field of Classification Search

CPC ..... A63B 23/2011; A63B 23/0216; A63B 23/035; A63B 23/0355; A63B 23/04; A63B 23/0405; A63B 21/062; A63B 21/0622; A63B 21/0624; A63B 21/0626; A63B 21/0628; A63B 21/06; A63B 21/15; A63B 21/151; A63B 21/154

See application file for complete search history.

(56) References Cited

U.S. PATENT DOCUMENTS

| | | | | |
|---|---|---|---|---|
| 5,056,779 | A * | 10/1991 | Webb | A63B 23/0211 482/100 |
| 2002/0052268 | A1* | 5/2002 | Morcillo-Quintero | A63B 23/0211 482/92 |
| 2002/0128124 | A1* | 9/2002 | Mosimann | A63B 23/0222 482/92 |
| 2011/0207584 | A1* | 8/2011 | Webber | A63B 21/0615 482/94 |
| 2012/0270707 | A1* | 10/2012 | Casadei | A63B 21/00 482/98 |
| 2013/0109542 | A1* | 5/2013 | Hockridge | A63B 21/062 482/94 |

* cited by examiner

*Primary Examiner* — Nyca T Nguyen
(74) *Attorney, Agent, or Firm* — Chun-Ming Shih

(57) ABSTRACT

A modular fitness device includes a fitness equipment and a receiving box. The fitness equipment has a power demand side. The receiving box is disposed at one side of the fitness equipment. A counterweight is disposed in the receiving box. The counterweight is connected to the power demand side via at least one follower. At least one connecting member is disposed between the fitness equipment and the receiving box. The receiving box is formed as a module disposed at one side of the fitness equipment. The production and assembly convenience of the modular fitness device is improved.

9 Claims, 6 Drawing Sheets

MODULAR FITNESS DEVICE

TECHNICAL FIELD

This invention relates to a structure of a fitness equipment, particularly to a modular fitness device.

BACKGROUND OF THE INVENTION

We know that exercise can maintain the body's health. Due to the busy modern life, it is difficult to have enough time to exercise outdoors, so a variety of fitness equipment come into market so that people can exercise indoors to maintain a healthy body.

It is generally provided by means of resistance fitness equipment to increase the effect of exercise. The resistance source of fitness equipment includes hydraulic force, pneumatic force, magnetic force and weight force. The weight force used as resistance source of fitness equipment is equipped with a counterweight which can adjust the weight according to an operator's demand. The counterweight is a plurality of counterweight blocks which are stacked together. The operator needs to meet a load requirement when using the instrument, and chooses the amount of counterweight blocks stacked with the load being as a whole resistance value for outputting to the fitness device. Thus, the operator can adjust the overall weight of the counterweight, and then operates the fitness device to start upward movement of counterweight. Thus, the counterweight forces the fitness device to return to its previous position by the weight of the counterweight so that the operator can perform pushing, pulling, lifting and pressing, etc. to do actions, and then exercise the operator's muscles to achieve the effect of sports and fitness.

In addition, due to the type of fitness equipment with diversity (such as shoulder press machine, rowing Rally machine, a pull-up training, etc.), but the difference on the configuration of the general technical counterweight is not great, the market is lack of deployment of different weight of heavy counterweight in modularization fashion and is lack of combination of sections of the fitness equipment.

SUMMARY OF THE INVENTION

In view of forgoing, an objective of the present invention is to improve the production and assembly convenience for the fitness device, thereby providing a modular fitness device. Its technical means comprises: a fitness equipment having a power demand side; and a receiving box for modularizing (in modular form or designed into a module) disposed at one side of the fitness equipment. A counterweight is disposed in the receiving box. The counterweight is connected to the power demand side via at least one follower. The fitness device further comprises at least one connecting member disposed between the fitness equipment and the receiving box. The receiving box is connected through the connecting member for modularizing and the receiving box is disposed at one side of the fitness equipment.

More specifically, the connecting member preferably has a L-shaped body.

The connecting member preferably comprises a support arm, a short module board plate and a long module board plate respectively connected and fixed to both ends of the support arm, and the connecting member is connected to the fitness equipment via the short module board plate and connected to the receiving box via the long module board plate.

The fitness equipment is preferably placed on a solid floor skeleton, the receiving box is placed on a solid floor frame, at least one fixing end is formed on the solid floor skeleton, at least one assembling end corresponding to the fixing end is formed on the sod floor frame, and the connecting member is disposed between the fixing end and the assembling end.

An amount of the connecting members is preferably plural and the connecting members are located at the bottom of the fitness equipment and the side of the receiving box.

The fixing end of the solid floor skeleton is preferably located at the bottom and the side of fitness equipment, and the assembling end of the solid floor frame is located at the bottom and the side of the receiving box for modularizing the plural connecting members.

The connecting member preferably comprises a support arm, a short module board plate and a long module board plate respectively fixed to and connected to the two ends of the support arm, and the connecting member is connected to the fixing end via the short module board plate and connected to the assembling end via the long module board plate.

The fixing end preferably comprises a bottom fixing terminal located at the bottom of the fitness equipment and a lateral fixing terminal located in the side of the fitness equipment, the assembling end comprises a left position module seat and a right position module seat located in the bottom of the receiving box, and an upper position module seat and a lower position module seat located in the side of the fitness equipment.

The bottom fixing terminal is preferably correspondent to and spaced from one of the left position module seat and the right position module seat, and the lateral fixing terminal is correspondent to and spaced from one of the upper position module seat and the lower position module seat.

The follower is preferably a combination of pulleys and lines, a combination of belts and pulleys, a combination of sprockets and chains, or a plurality of phase rodent wheels.

An upper adapter plate is preferably disposed at one side of the upper position module seat, a lower adapter plate is disposed at one side of the lower position module seat and the follower is assembled to one of the upper adapter plate and the lower adapter plate.

A channel is preferably formed in the connecting member, and the follower is respectively connected to the counterweight and the power demand side via the channel.

An open frame chamber is preferably formed between the receiving box and the solid floor frame.

According to the above techniques, the present invention has the following advantages. In order to enhance the common interchangeability of different fitness equipment and the receiving box, and in order to obtaining modularizing effect of matters between the fitness equipment and the receiving box, and in order to combine the receiving box with a variety of different fitness equipment, the connecting member is capable of guiding the power source between the fitness equipment and the receiving box, thereby increasing the production and assembly convenience.

In addition, the relevant technical details for the implementation of the present invention will be set forth in a subsequent embodiment and the drawings.

DETAILED DESCRIPTIONS OF THE INVENTION

Figure 1:
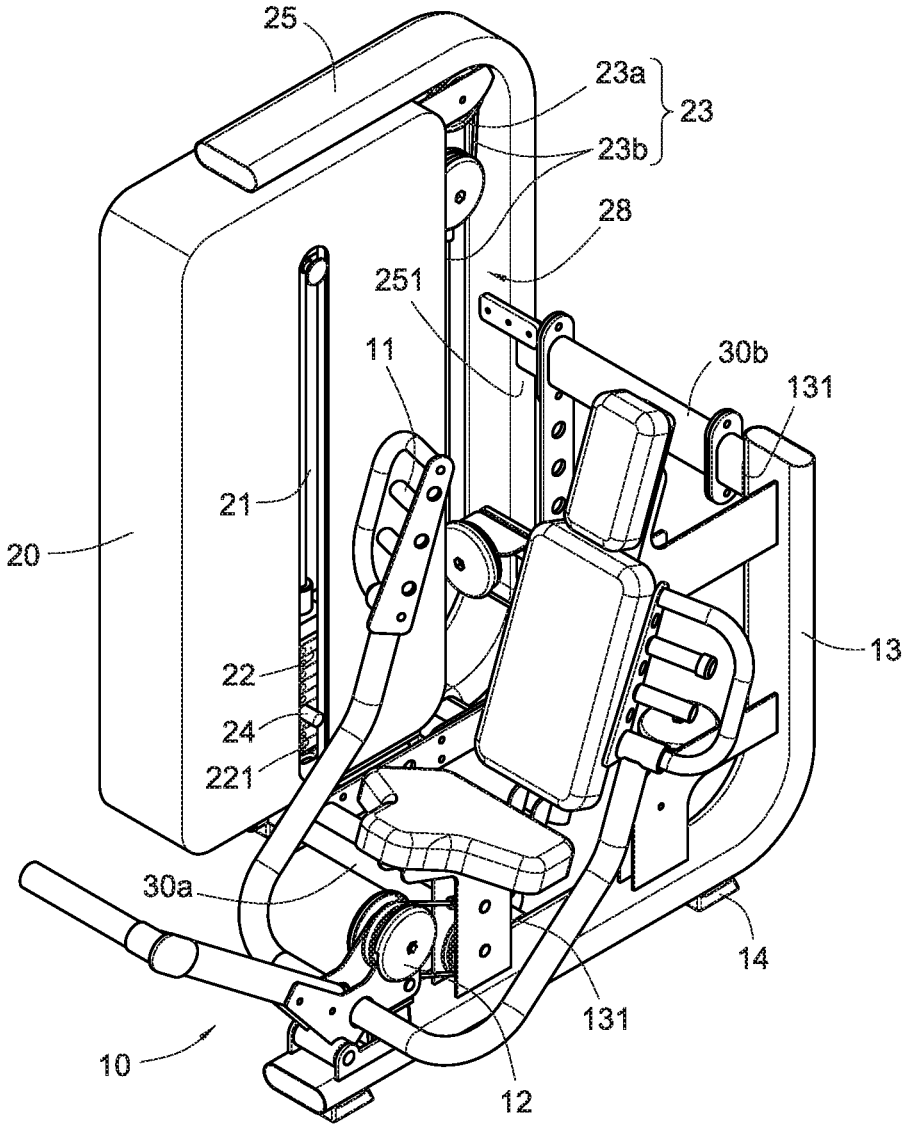
FIG. 1 is a perspective view of a preferable embodiment of the modular less device of the present invention.
Figure 2:
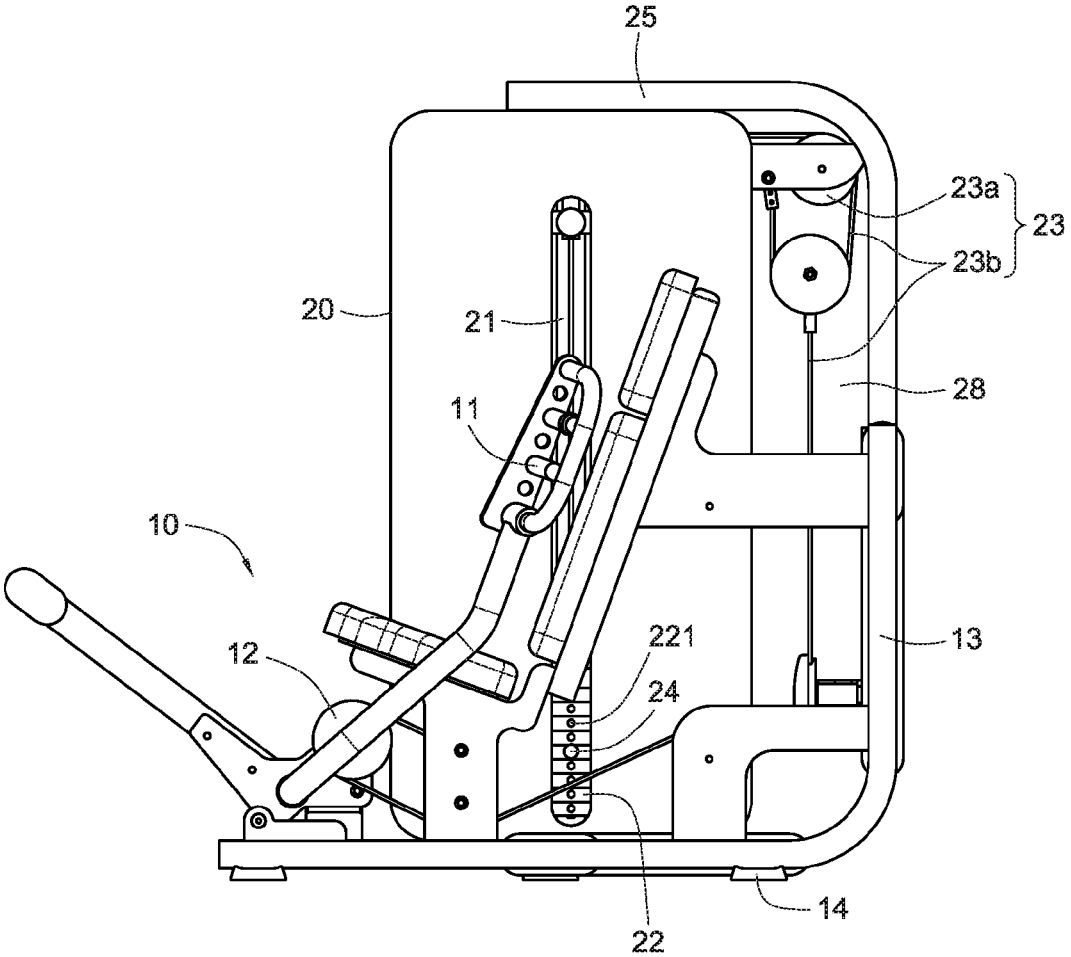
FIG. 2 is a side view of FIG. 1.

First, please refer to FIGS. 1 and 2, they disclose a preferred embodiment of the present invention illustrating a modular fitness device comprising a fitness equipment 10, a receiving box 20 and at least one connecting member, wherein:

The fitness equipment 10 implemented in the embodiment may be constituted by a metal linkage, and the linkage is formed with an urging end 11. The operator drives the linkage by the operator's hand or foot to exert an action, such as push, pull, lift and pressure and other repetitive motion, upon the linkage in order to exercise the muscles. Further, the fitness equipment 10 has a power demand side 12 which is fastened to the linkage. The operator can drive the link by means of driving the urging end 11 and transmits to the power demand side 12 to move through the linkage.

The fitness equipment 10 is fixedly placed on a solid floor skeleton 13 which may be made of metal linkage in implementation, and is located at the rear side of fitness equipment 10. The fitness equipment 10 is placed on the ground by using the solid floor skeleton 13. In implementation, an anti-slip pad 14 is fixed and placed between the solid floor skeleton 13 and the ground. The anti-pad 14 can be made of an anti-slip material. The anti-slip pad 14 can increase the friction force between the anti-slip pad 14 and the contacting solid floor skeleton 13 when the anti-slip pad 14 is in contact with the ground to avoid the shaking instability or slippage of the fitness equipment 10 when the force is exerted by the operator, thereby increasing the operating safety when he/she uses the fitness equipment 10.

The receiving box 20 is a flat box which is placed beside the fitness equipment. A counterweight 22 is contained inside the receiving box 20, and includes a plurality of counterweight blocks formed by stacking together. In the specific embodiment, an adjustment hole 221 is formed on each of the counterweight blocks. An operator can select an amount of the chosen counterweight blocks by inserting a pin 24 into the adjustment hole 221 according to a load requirement for using fitness equipment 10. An overall load is used as a resistance value for outputting to the fitness equipment 10, and the counterweight 22 can move in a vertical direction perpendicular to the ground in receiving box 20 so that the counterweight 22 is driven to move upward by the operator and then the counterweight 22 retreats back into original position by its weight.

The receiving box 20 is placed on a solid floor frame 25 which is made of metal in implementation. The solid floor frame 25 is placed at the rear side of the receiving box 20 which is placed on the ground through the solid floor frame 25. Furthermore, an open frame chamber 28 is formed between the receiving box 20 and the solid floor frame 25. At least one follower 23 is disposed in the frame chamber 28. The counterweight 22 is connected to the power demand side 12 via the follower 23. Thus the operator can drive the power demand side 12 to drive and urge the counterweight 22 to move upward, and then the operator controls and the drives the power demand side 12 to retreat back to its original position.

The connecting member is placed between the fitness equipment 10 and the receiving box 20. The connecting member may be made of metal, non-metal, plastics material or other materials having supporting strength. The receiving box 20 for modularizing is placed at one lateral side of the fitness equipment 10 via the connecting member. The connecting member has a fixed length and may be used for spacing the fitness equipment 10 from the receiving box 20. In addition to provide a gap length between the fitness equipment 10 and the receiving box 20 for modularizing, the connecting member is used for avoiding collision with the receiving box 20 when the operator uses the fitness equipment 10. Furthermore a fixing end 131 is formed on the solid floor skeleton 13, and an assembling end 251 corresponding to the fixing end 131 is formed on the solid floor frame 25. Two ends of the connecting member is assembled and fastened on the fixing end 131 and the assembling end 251 for further connecting to the fitness equipment 10 and the receiving box 20, respectively.

Figure 3:
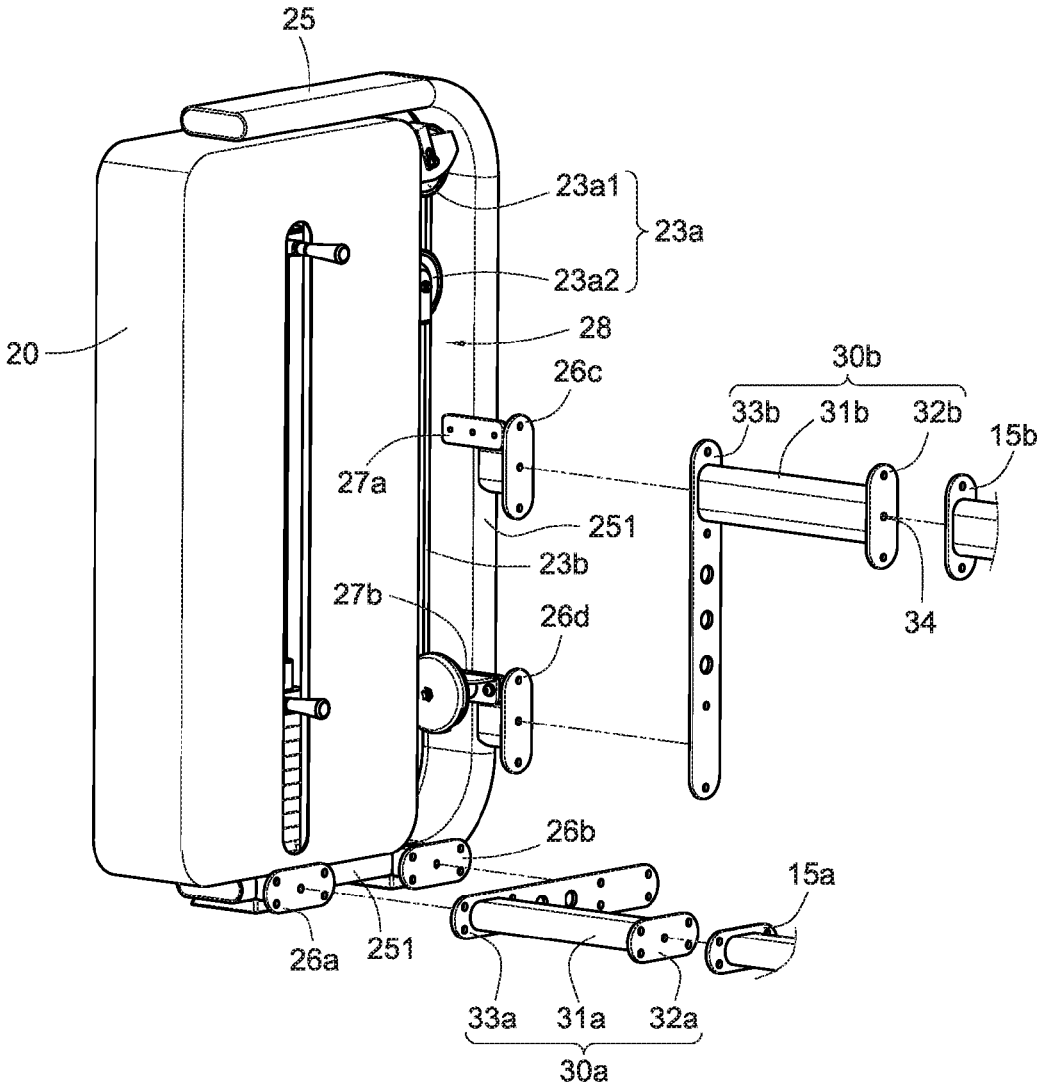
FIG. 3 is a perspective view of a connecting member and a fixing end and an assembling end of the present invention.

Please refer to FIG. 3. The amount of the connecting member in the embodiment may be a plural number. The connecting member comprises a bottom connecting piece 30*a* disposed between the fitness equipment 10 and the bottom of the receiving box 20, and a lateral connecting piece 30*b* disposed between the fitness equipment 10 and the bottom of the receiving box 20. The bottom connecting piece 30*a* comprises a support arm 31*a*. A shod module board plate 32*a* and a long module board plate 33*a* are fixed and connected to the two ends of the support arm 31*a*. The lateral connecting piece 30*b* comprises a support arm 31*b*. A short module board plate 32*b* and a long module board plate 33*b* are secured and connected to the two ends of the support arm 31*b* so that the bottom connecting piece 30*a* and lateral connecting piece 30*b* show a L-shape.

In a particular embodiment, the bottom connecting piece 30*a* is connected to the fitness equipment 10 via the short module board plate 32*a* and the lateral connecting piece 30*b* is connected to the fitness equipment 10 via a short module board plate 32*b*. The bottom connecting piece 30*a* is connected to the receiving box 20 via the long module board plate 33*a* and the lateral connecting piece 30*b* is connected to the receiving box 20 via the long module board plate 33*b*. Further, the bottom connecting piece 30*a* and the lateral connecting piece 30*b* are secured and fastened to a fixing end via the shod module board plates 32*a*, 32*b*, respectively, for connecting to the fitness equipment 10, and are secured and fastened to an assembling end via the long module board plates 33*a*, 33*b*, respectively, for connecting to the receiving box 20.

Please refer to FIG. 3 which demonstrates that the fixing end comprises a bottom fixing terminal 15*a* disposed at the bottom of the fitness equipment 10 and a lateral fixing terminal 15*b* located at its one side. The assembling end comprises a left position module seat 26*a* and a right position module seat 26*b* at the bottom of the receiving box 20, and an upper position module seat 26*c* and a lower position module seat 26*d* located at one side of the receiving box 20. In implementation, the bottom fixing terminal 15*a* is placed correspondent to and spaced apart from one of the left position module seat 26*a* and the right position module seat 26*b*. The lateral fixing terminal 15*b* is placed correspondent to and spaced apart from one of the upper position module seat 26*c* and the lower position module seat 26*d* so that the fitness equipment 10 can be connected to the receiving box 20 through the corresponding module seats by means of the bottom fixing terminal 15*a* and the lateral fixing terminal 15*b*.

Figure 4:
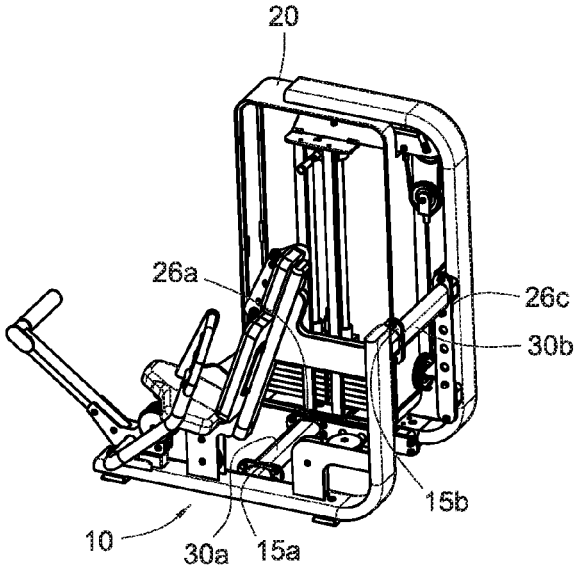
FIGS. 4 to 7 are perspective views showing different embodiments of the connecting member mounted by assembly methods of the present invention.
Figure 5:
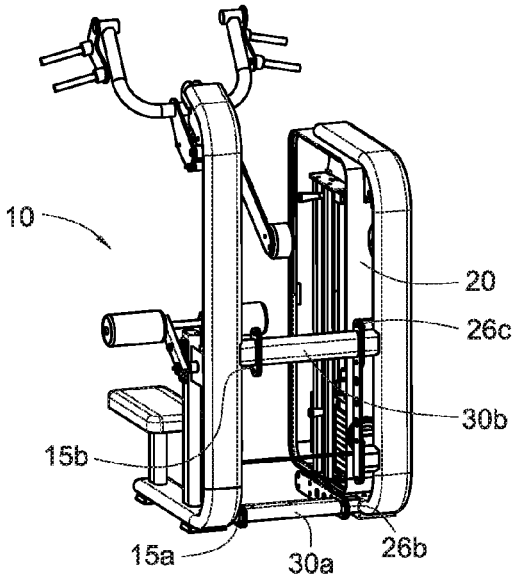
Figure 6:
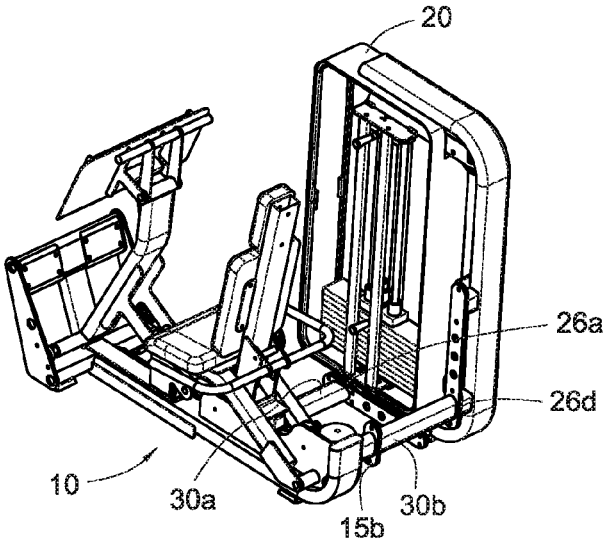
Figure 7:
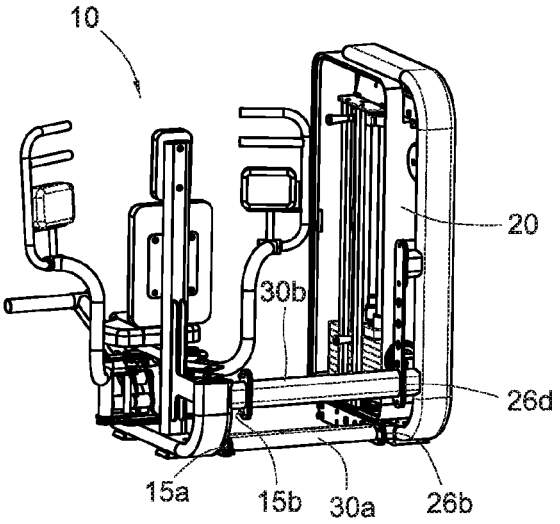

Please refer to FIGS. 4 to 7 which demonstrate that every kind of fitness equipment 10 has different levels and centers of gravity, thus allowing different arrangement positions of the bottom fixing terminal 15*a* and the lateral fixing terminal 15*b*, and then the corresponding module seats are different. As shown in FIG. 4, in this embodiment the bottom fixing terminal 15*a* is correspondent to the left position module seat 26*a*, while the lateral fixing terminal 15*b* is correspondent to the upper position module seat 26*c*. As shown in FIG. 5, the bottom fixing terminal 15*a* is correspondent to the right position module seat 26*b*, while the lateral fixing terminal 15*b* is correspondent to the upper position module seat 26*c*. As shown in FIG. 6, in this embodiment the bottom fixing terminal 15*a* is correspondent to the left position module seat 26*a*, while the lateral fixing terminal 15*b* is correspondent to the lower position module seat 26*d*. As shown in FIG. 7, in this embodiment the bottom fixing terminal 15*a* is correspondent to the right position module seat 26*b*, while the lateral fixing terminal 15*b* is correspondent to the lower position module seat 26*d*. In the above-described embodiments for the various models of the fitness equipment 10 the receiving box 20 can be connected via the bottom connecting piece 30*a* and the lateral connecting piece 30*b* in a different manner and configuration in order to achieve the effect of modularization and to reduce inconvenience in the production and assembly of fitness equipment 10 due to diversity of models.

Please refer to FIGS. 1 and 2 which demonstrate that the follower 23 in the embodiment may be a combination of pulleys and lines, or a combination of pulleys and belts, or will a combination of sprockets and chains. In addition, it can be made of a combination of a plurality of phase rodent wheels. In this invention a combination of cable pulleys 23*a* and a connecting line 23*b* used as a follower is demonstrated with further descriptions as follows.

The connecting line 23*b* is disposed around the pulley 23*a*. In the implementation the connecting line 23*b* can be made of a flexible cable. The two ends of connecting line 23*b* are connected to the power demand side 12 and the counterweight 22 so that the power demand side 12 and the counterweight 22 can be linked to each other via the connecting line 23*b*. Furthermore, in the implementation the pulley 23*a* may contain a fixed pulley 23*a*1 and a movable pulley 23*a*2 (as shown in FIG. 3). The fixed pulley 23*a*1 and the movable pulley 23*a*2 are pivotally disposed in the frame chamber 28. The connecting line 23*b* is wound on the fixed pulley 23*a*1 and used for changing the direction of movement of the connecting line 23*b* so that it can change the amount of the output force of the connecting line 23*b*. The connecting line 23*b* is wound on the fixed pulley 23*a*1 and the movable pulley 23*a*2 so that the power demand side 12 and the counterweight 22 are connected to each other via the connecting line 23*b* and that output power can be changed.

Figure 8:
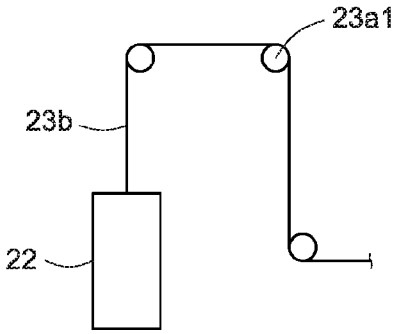
FIGS. 8 to 10 are configuration diagrams of different embodiments of followers connected to the counterweight by connection modes of the present invention.
Figure 9:
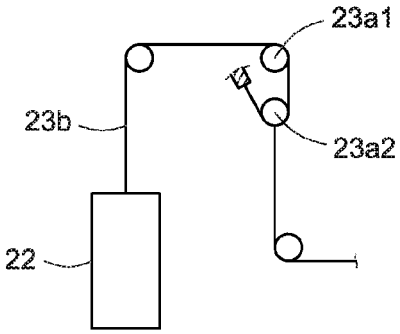
Figure 10:
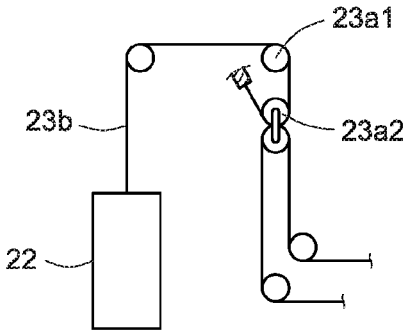

Please refer to FIGS. 8 to 10 illustrating different connections between the pulley 23*a* and the connecting line 23*b*. As shown in FIG. 8, the connecting line 23*b* is connected to the counterweight 22 through the fixed pulleys 23*a*1 so that it can change the direction of movement of the connecting line 23*b*, but it cannot change the amount of the output force of the connecting line 23*b*. As shown in FIGS. 9 and 10, the connecting line 23*b* is connected to the counterweight 22 through the fixed pulley 23*a*1 and the movable pulley 23*a*2 so that it not only can change the direction of movement of the connecting line 23*b*, but also can change the amount of the output force of the connecting line 23*b*. The effects of the three different connections can be generated so different that the operator can provide the required resistance value in fitness sport exercise.

Refer to FIG. 3 indicating that at the solid floor frame 25 adjacent to one side of the upper position module seat 26*c*, an upper adapter plate 27*a* is disposed, and at the solid floor frame 25 adjacent to one side of the lower position module seat 26*d*, a lower adapter plate 27*b* is disposed. Since the structural configuration of the fitness equipment 10 has various models, the outlet location of the fitness equipment 10 is also different. When the connecting line 23*b* is connected to the power demand side 12 and the counterweight 22, the two ends of the connecting line 23*b* could be easily connected to the power demand side 12 and the counterweight 22 because the fixed pulley 23*a*1 is secured and fastened to the upper adapter plate 27*a* or the lower adapter plate 27*b*. Furthermore, a channel 34 is formed in the bottom connecting piece 30*a* and the lateral connecting piece 30*b* so that the connecting line 23*b* extends and passes through the channel 34, and is connected to the power demand side 12 and the counterweight 22, thereby it guides the connecting line 23*b* for transmitting power between the fitness equipment 10 and the receiving box 20, and thus it enhances the safety and security hen the operator uses the fitness equipment 10.

Please refer to FIGS. 1 and 2 indicating that an operation hole 21 with an elongated shape is disposed on the receiving box 20 at one side of the fitness equipment 10. Because the counterweight 22 is composed of a plurality of counterweight blocks stacked together, the operator can operate the operation hole 21 to adjust the position of the pin 24 in order to select the amount of counterweight blocks stacked, and to choose the amount of counterweight blocks stacked according to the load demand of the fitness equipment 10 and to use the overall load as an output resistance value for the fitness equipment 10.

The modularizing of fitness equipment 10 and receiving box 20 in this invention can improve their production and assembly convenience.

The above examples are merely expressing the invention of a preferred embodiment, but it cannot therefore be construed as a limitation of the scope of invention patents. Thus, the scope of the invention shall be defined in contents of the claims.

I claim:

1. A modular fitness device comprising:

a power demand side; and a receiving box that contains a counterweight to the power demand side, wherein the power demand side and the receiving box for modularizing are placed with respect to each other; at least one connecting member in between the power demand side and the receiving box; the receiving box is connected to the power demand side via the connecting member; the counterweight, which is a weight source, is placed inside the receiving box and is connected to the power demand side via at least one follower, wherein the power demand side is placed on and attached to a solid floor skeleton while the receiving box is placed on and attached to a solid floor frame; at least one fixing end is attached to the solid floor skeleton and at least one assembling end corresponding to the fixing end is attached to the solid floor frame; the receiving box connects the solid floor skeleton and the solid floor frame via the fixing end and the assembling end, respectively;

wherein the connecting member includes a short module board plate of a supporting arm connected to the fixing end of the power demand side, and a long module board plate of the support arm is connected to the assembling end of the receiving box;

wherein the fixing end includes a bottom fixed terminal and a lateral fixed terminal at the bottom and at a side of the power demand side respectively; the assembling end of the receiving box includes a bottom assembling end and a side assembling end; the bottom assembling end includes two module seats, a left position module seat and a right position module seat, located at the bottom of the receiving box; the side assembling end includes two module seats, an upper position module seat and a lower position module seat, located at a side of the receiving box.

2. The modular fitness device according to claim 1, wherein the connecting member forms an L-shaped body.

3. The modular fitness device according to claim 1, wherein the connecting member includes:

the support arm;

the short module board plate; and the long module board plate, wherein the short and long module board plates are connected firmly to two ends of the support arm; the short module board plate is connected to the power demand side; the long module board plate is connected to the receiving box.

4. The modular fitness device according to claim 1 comprising a plurality of connecting members located at a side and a bottom of the receiving box and the power demand side.

5. The modular fitness device according to claim 1, wherein the bottom fixed terminal of the power demand side is corresponded to either the left position module seat or the right position module seat of the receiving box, and the lateral fixed terminal of the power demand side is corresponded to either the upper module seat or the lower position module seat.

6. The modular fitness device according to claim 1, wherein the follower that connects the counterweight and the power demand side includes a combination of pulleys and lines, or a combination of belts and pulleys, or a combination of sprockets and chains.

7. The modular fitness device according to claim 1, wherein an upper adapter plate is located at a side of the upper position module seat, and a lower adapter plate is located at a side of the lower position module seat; the follower is assembled to one of the upper adapter plate and the lower adapter plate.

8. The modular fitness device according to claim 1, wherein a channel is formed between the connecting member and the follower, which connects the counterweight and the power demand side; when the power demand side is provided with a force source by an operator, the channel will transmit the force from the power demand side to the receiving box.

9. The modular fitness device according to claim 1, wherein an open chamber is formed in between the receiving box and the solid floor frame which contains a plurality of followers; the modular fitness device is configured to provide an operator with various resistance values.

* * * * *